US006357260B1

(12) United States Patent
Lutz

(10) Patent No.: US 6,357,260 B1
(45) Date of Patent: Mar. 19, 2002

(54) SCENTED BRACELET KIT

(75) Inventor: Anita M. Lutz, Circleville, OH (US)

(73) Assignee: Bath & Body Works, Inc., Reynoldsburg, OH (US)

( * ) Notice: Subject to any disclaimer, the term of this patent is extended or adjusted under 35 U.S.C. 154(b) by 0 days.

(21) Appl. No.: 09/532,568

(22) Filed: Mar. 22, 2000

(51) Int. Cl.[7] ..... A44C 13/00

(52) U.S. Cl. ..... 63/1.11; 63/1.15; 63/33; 63/DIG. 2; 206/6.1

(58) Field of Search ..... 63/1.11, 1.15, 63/33, DIG. 2, 3; 206/575, 227, 6.1, 540, 457, 458; 446/73–75; 434/99, 83

(56) References Cited

U.S. PATENT DOCUMENTS 195,324 A * 9/1877 Atkinson
3,567,119 A * 3/1971 Wilbert et al. ..... 239/6
3,733,852 A * 5/1973 Johnson et al. ..... 63/2
4,022,318 A * 5/1977 Goodman ..... 206/223
4,237,702 A * 12/1980 Caverly ..... 63/2
4,293,602 A * 10/1981 Coffey et al. ..... 428/28
4,406,296 A * 9/1983 Wexler et al. ..... 132/148
4,950,542 A * 8/1990 Barker ..... 428/403
6,014,871 A * 1/2000 Romano ..... 63/41
6,051,547 A * 4/2000 Ornitz ..... 512/1
6,089,947 A * 7/2000 Green ..... 446/268
6,235,705 B1 * 5/2001 Zembrodt et al. ..... 510/519

* cited by examiner

*Primary Examiner*—Anthony Knight
*Assistant Examiner*—Alison K. Pickard
(74) *Attorney, Agent, or Firm*—Colucci & Umans; Peter C. Michalos; Angelo Notaro

(57) ABSTRACT

A scented friendship bracelet kit contains several ornamental beads, a plurality of polymer pellets impregnated with a fragrance, a mesh fabric bundled about the beads and pellets and a tie string holding the fabric bundle together. The kit is provided as a bundle and can be used as an air freshener

9 Claims, 1 Drawing Sheet

SCENTED BRACELET KIT

FIELD AND BACKGROUND OF THE INVENTION

The present invention relates generally to the field of costume jewelry and in particular to a new and useful bracelet kit containing a fragrance carrier. The kit can be used as both a sachet and to make a bracelet. The kit is especially adapted to make friendship bracelets.

Friendship bracelets are a type of costume jewelry having different ornaments threaded on a string, often by young children. The bracelets are traded among groups of children as a token of friendship. The bracelets are simple to make using ornaments having pre-drilled holes through them for easy threading on a string. The ornaments and string are typically obtained separately, and the ornaments are not scented; the bracelets function only as costume jewelry.

Other types of craft kits for making decorative items, such as jewelry are known, such as the jewelry kit having decorative yarn or beads disclosed in U.S. Pat. No. 4,022,318 The kit contains a preformed metal frame shaped like a flower, animal, insect, etc. Beads and yarn are included as jewelry items for decorating the metal frame. The beads used in the kit do not have through-holes for stringing, but instead, are intended to be glued to the metal frame. None of the articles in the kit is scented.

A toy jewelry kit for making rings and tube bracelets is taught by U.S. Pat. No. 5,887,448. Bracelets may be formed by filling hollow tubes with water and coloring or particulates and sealing the tubes using a machine provided as part of the kit. Charms can be threaded onto the bracelet for additional decorative effect. None of the components of the kit is disclosed as being perfumed or scented.

Other patents disclose jewelry with a scent, as in U.S. Pat. No. 4,950,542, which teaches a string of coated beads having a scent. The coating is an emulsion of polyurethane and essential oils. The beads are only coated with the emulsion and are not impregnated with scent.

U.S. Pat. No. 195,324 discloses a scented charm for use on a bracelet or necklace. The charm is made of a porous earthenware and scented by exposing the charm to a liquid perfume for absorption by the earthenware.

A natural botanical jewelry ornament is disclosed by U.S. Pat. No. 4,293,602. The ornament is formed by combining natural botanical plant material, essential oils and a fluorocarbon resin binder. TEFLON 30 from DuPont is disclosed as one suitable fluorocarbon resin binder. The mixture is shaped into a desired form for the ornament.

Fragrances and air fresheners are also generally known in the art.

U.S. Pat. No. 3,567,119 teaches a method of improving the diffusion of fragrances from polymers. Example 1 of the patent discloses a method of making perfume-impregnated polyethylene beads by adding an anionic surfactant to the perfume before mixing with polyethylene and coloring. The amount of perfume in the example is about 3% by weight.

However, none of the prior patents teach a self-contained kit for making a bracelet combining scented fragrance carriers and ornaments.

SUMMARY OF THE INVENTION

It is an object of the present invention to provide a kit which has both a pleasant fragrance and which can be used to make a decorative bracelet or other jewelry.

It is a further object of the invention to provide a jewelry kit which can be used as an air freshener.

Accordingly, a scented friendship bracelet kit contains several ornamental beads, a plurality of polymer pellets impregnated with a fragrance, a mesh fabric bundled about the beads and pellets and a tie string holding the fabric bundle together. The kit is provided as a bundle and can be used as an air freshener. The fragranced polymer pellets will continuously provide a scent over length of time.

To make a bracelet using the kit, the mesh fabric bundle is opened by untying the tie string. The ornamental beads are removed and strung on the tie string, which is sufficiently long to hold several ornamental beads and then tie the ends to form a bracelet. When the bracelet is completed, the mesh fabric and pellets may be discarded or, alternatively, rebundled and closed with other means to continue use as an air freshener.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
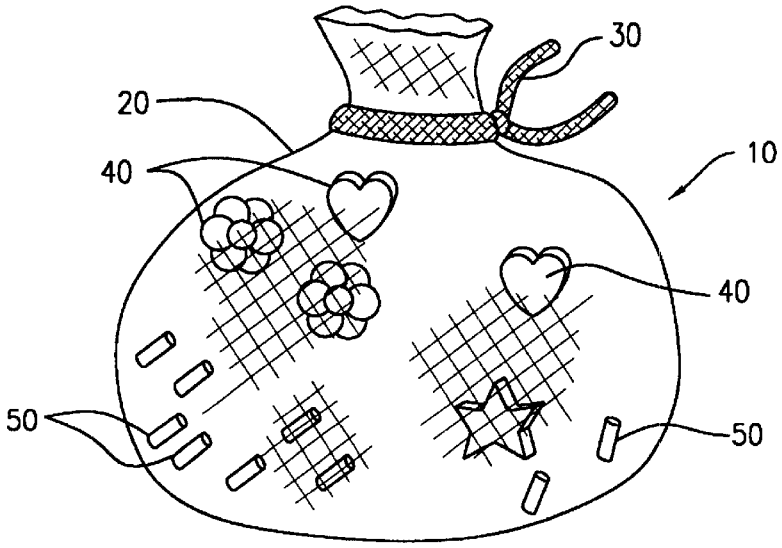
FIG. 1 is a perspective view of an assembled kit of the invention.

Referring now to the drawings, in which like reference numerals are used to refer to the same or similar elements, FIG. 1 shows a bracelet kit 10 of the invention having a bag 20 containing a plurality of ornaments 40 and scented pellets 50. The bag 20 can be closed with a tie string 30 to hold the ornaments 40 and pellets 50 inside the bag 20.

The pellets 50 are preferably a polyethylene, polypropylene or mixtures of the two, impregnated with about 25% by weight fragrance which is suitable for use with the selected polymer. The fragranced polymer pellets 50 will continuously provide a scent over length of time, such as 30 days.

The fabric of the bag 20 is porous, such as a plastic mesh or linen, which permits the scent from the pellets 50 to diffuse into the air, providing a pleasant scent. The kit 10 can be used as a sachet to scent an area, such as a student locker or a drawer. At the same time, the proximity of the ornaments 40 to the pellets 50 causes the ornaments 40 to become fragranced as well.

The ornaments 40 can be beads in a variety of shapes, each having a through-holes for stringing on the tie string 30. The material selected for the ornaments 40 is one which is durable, but will become fragranced as a result of being in close proximity to the pellets 50.

The tie string 30 can be any type of string for making friendship bracelets. The tie string 30 can be a braided cord, for example, a shoe string.

Figure 2:
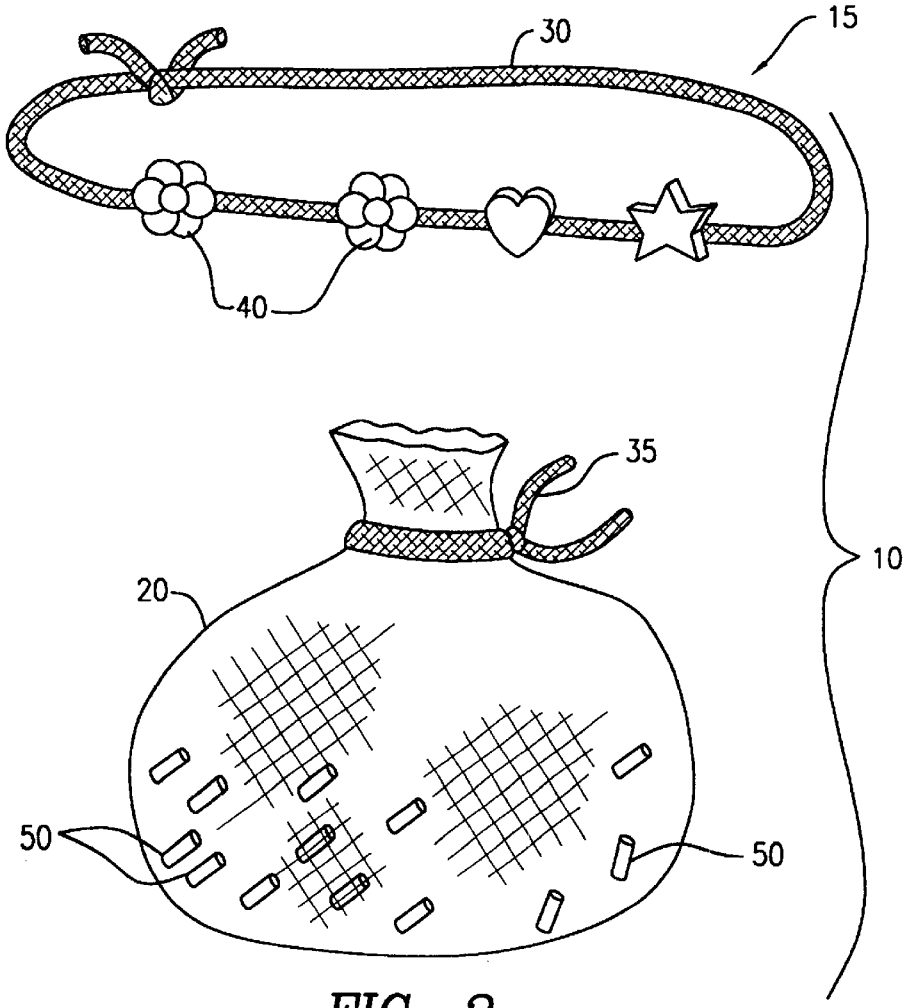
FIG. 2 is a perspective view of a bracelet made from part of the kit of FIG. 1 and a sachet made from the remaining parts of the kit of FIG. 1.

In FIG. 2, the kit 10 has been used to make a friendship bracelet 15 with ornaments 40 threaded onto tie string 30. The remaining pellets 50 and bag 20 can be tied with a second string 35, or the string 35 can be a piece of the tie string 30 cut off from the portion used to make the bracelet 15. The pellets 50 and bag 20 can then be used as a sachet to scent an area until the fragrance wears out on the pellets 50.

As an alternative to using a plurality of pellets 50, a single piece of polymer could be used as the fragrance carrier, provided it will fit within the bag 20. The amount of fragrance diffused by the carrier will be increased the greater the surface area of the carrier. Thus, pellets 50 are preferred due to the substantial diffusion surface area of the pellets 50.

While a specific embodiment of the invention has been shown and described in detail to illustrate the application of the principles of the invention, it will be understood that the invention may be embodied otherwise without departing from such principles.

What is claimed is:

1. A kit for making a friendship bracelet, the kit comprising:

fragrance carrier means for containing a quantity of a fragrance and diffusing the fragrance;

a plurality of ornaments having through-holes, the ornaments becoming fragranced by contact with and close proximity to the fragrance carrier means;

a bag having a top opening and made of a porous material that permits the fragrance to pass through, the bag for holding the fragrance carrier means and the plurality of ornaments; and a tie string for holding the bag top opening closed, the tie string being used to form a bracelet when at least some of plurality of ornaments are strung on the tie string and the ends of the tie string are connected together to make a closed loop.

2. A kit according to claim 1, wherein the bag is made of one of linen and plastic mesh.

3. A kit according to claim 2, wherein the fragrance carrier means comprises a plurality of fragrance pellets impregnated with fragrance.

4. A kit according to claim 3, wherein the plurality of fragrance pellets are made of one of polyethylene, polypropylene and mixtures thereof.

5. A kit according to claim 4, wherein the plurality of fragrance pellets are impregnated with about 25% by weight of fragrance.

6. A kit according to claim 1, wherein the tie string is a shoe string.

7. A kit according to claim 1, wherein the fragrance carrier means comprises a plurality of fragrance pellets impregnated with fragrance.

8. A kit according to claim 7, wherein the plurality of fragrance pellets are made from one of polyethylene, polypropylene and mixtures thereof.

9. A kit according to claim 8, wherein the plurality of fragrance pellets are impregnated with about 25% by weight of fragrance.

* * * * *